US007278022B2

(12) United States Patent
Suzuki

(10) Patent No.: US 7,278,022 B2
(45) Date of Patent: Oct. 2, 2007

(54) INFORMATION PROCESSING APPARATUS AND INFORMATION PROCESSING METHOD

(75) Inventor: Katsunari Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 10/533,100

(22) PCT Filed: Nov. 10, 2004

(86) PCT No.: PCT/JP2004/017036

§ 371 (c)(1),
(2), (4) Date: Apr. 28, 2005

(87) PCT Pub. No.: WO2005/050457

PCT Pub. Date: Jun. 2, 2005

(65) Prior Publication Data

US 2006/0015739 A1 Jan. 19, 2006

(30) Foreign Application Priority Data

Nov. 21, 2003 (JP) ..... 2003-392377

(51) Int. Cl.
*H04K 1/00* (2006.01)

(52) U.S. Cl. ..... 713/182; 713/193; 713/194; 726/2

(58) Field of Classification Search ..... None
See application file for complete search history.

(56) References Cited

U.S. PATENT DOCUMENTS

2003/0188199 A1* 10/2003 Tadano et al. ..... 713/201

FOREIGN PATENT DOCUMENTS

| | | |
|---|---|---|
| JP | 11-183194 | 7/1999 |
| JP | 2001-344369 | 12/2001 |
| JP | 2003-110490 | 4/2003 |
| JP | 2003-242285 | 8/2003 |
| JP | 2003-288275 | 10/2003 |

OTHER PUBLICATIONS

"Technical Report, 860 MHz-930 MHz Class I Radio Frequency Identification Tag Radio Frequency & Logical Communication Interface Specification Candidate Recommendation, Version 1.0.1.", Auto-ID Center (Nov. 14, 2002).

* cited by examiner

*Primary Examiner*—Taghi Arani
(74) *Attorney, Agent, or Firm*—Fitzpatrick, Cella, Harper & Scinto

(57) ABSTRACT

An information processing apparatus having a security server and a reader/writer includes a demodulator of the reader/writer for reading information from an RFID tag, a modulator of the reader/writer for writing information into the RFID tag and also writing area information indicating whether the RFID tag exists in a secret area, a memory for storing the information read from the RFID tag by the demodulator and the information written into the RFID tag by the modulator, and a controller for controlling the demodulator and the modulator. When the area information read from the RFID tag by the demodulator indicates that the RFID tag exists in a predetermined area, the controller precludes from reading predetermined information stored in the RFID tag, and controls the modulator so as to write the area information indicating that the RFID tag does not exist in the predetermined area.

22 Claims, 6 Drawing Sheets

| NO. | USER ID | ENTRY/EXIT SITUATION | SAVED SECRET INFORMATION |
|---|---|---|---|
| 1 | 13114032 | ENTRY | —— |
| 2 | 13114039 | EXIT | aaa · fxf |
| ⋮ | ⋮ | ⋮ | ⋮ |

INFORMATION PROCESSING APPARATUS AND INFORMATION PROCESSING METHOD

TECHNICAL FIELD

The present invention relates to an information processing apparatus and an information processing method.

BACKGROUND ART

Conventionally, a security system which administrates entrance/exit of persons to/from a room (i.e., a predetermined area) by authenticating them with use of portable storage media such as magnetic cards or the like has been brought to realization (e.g., Japanese Patent Application Laid-Open No. 11-303478).

Incidentally, in case of using the portable storage medium such as a non-contact IC memory (e.g., an. RFID (Radio Frequency IDentification) memory) or the like, it is thought that the function to read information from the portable storage medium is provided in an MFP (Multi Functional Printer). In this case, it is thought that the MFP reads job information to be executed by the MFP from the portable storage medium and then actually executes a job in response to the read job information. Incidentally, as an example of executing the job, there is a print process of printing an image on paper based on image data.

In such use as described above, when the portable storage medium is brought out from the room (predetermined area) where entrance and exit of persons are administrated (for example, when the portable storage medium is brought out from a company, a department or the like) in the state that the information (e.g., internal consumption data, privileged data or the like) to be concealed (this information is also called secret information) has been retained in the portable storage medium, there is a possibility that a problem occurs. For example, if the portable storage medium loses, there is a fear that the secret information stored in the lost portable storage medium is maliciously read by the third person. In this case, there is a possibility that security concerning the information to be concealed decreases.

DISCLOSURE OF THE INVENTION

The present invention is made in consideration of the above conventional problem, and an object thereof is to provide an improved information processing apparatus and an improved information processing method.

Another object of the present invention is to provide an information processing apparatus in which, in the state that information called secret information to be concealed is stored and held in a portable storage medium, the secret information is never read by a third person even when the portable storage medium is brought out from a predetermined area, and an information processing apparatus which is adopted to the information processing method.

One aspect of the present invention is to provide an information processing apparatus comprising:

an information reading unit adapted to read information from a portable storage medium;

an information writing unit adapted to write information into the portable storage medium, the information writing unit being adapted to write area information indicating whether or not the portable storage medium exists in a predetermined area;

a storage unit adapted to store the information read from the portable storage medium by the information reading unit and the information written into the portable storage medium by the information writing unit; and a control unit adapted to control the information reading unit and the information writing unit, wherein, when the area information read from the portable storage medium by the information reading unit indicates that the portable storage medium exists in the predetermined area, the control unit is adapted to preclude from reading predetermined information stored in the portable storage medium, and to control the information writing unit to write the area information indicating that the portable storage medium does not exist in the predetermined area.

Another aspect of the present invention is to provide an information processing method comprising:

an information reading step of reading information from a portable storage medium; and an information writing step of writing information into the portable storage medium, the information writing step being adapted to write area information indicating whether or not the portable storage medium exists in a predetermined area, wherein, when the area information read from the portable storage medium in the information reading step indicates that the portable storage medium exists in the predetermined area, the information writing step is adapted to preclude from reading predetermined information stored in the portable storage medium, and to write the area information indicating that the portable storage medium does not exist in the predetermined area.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Figure 1:
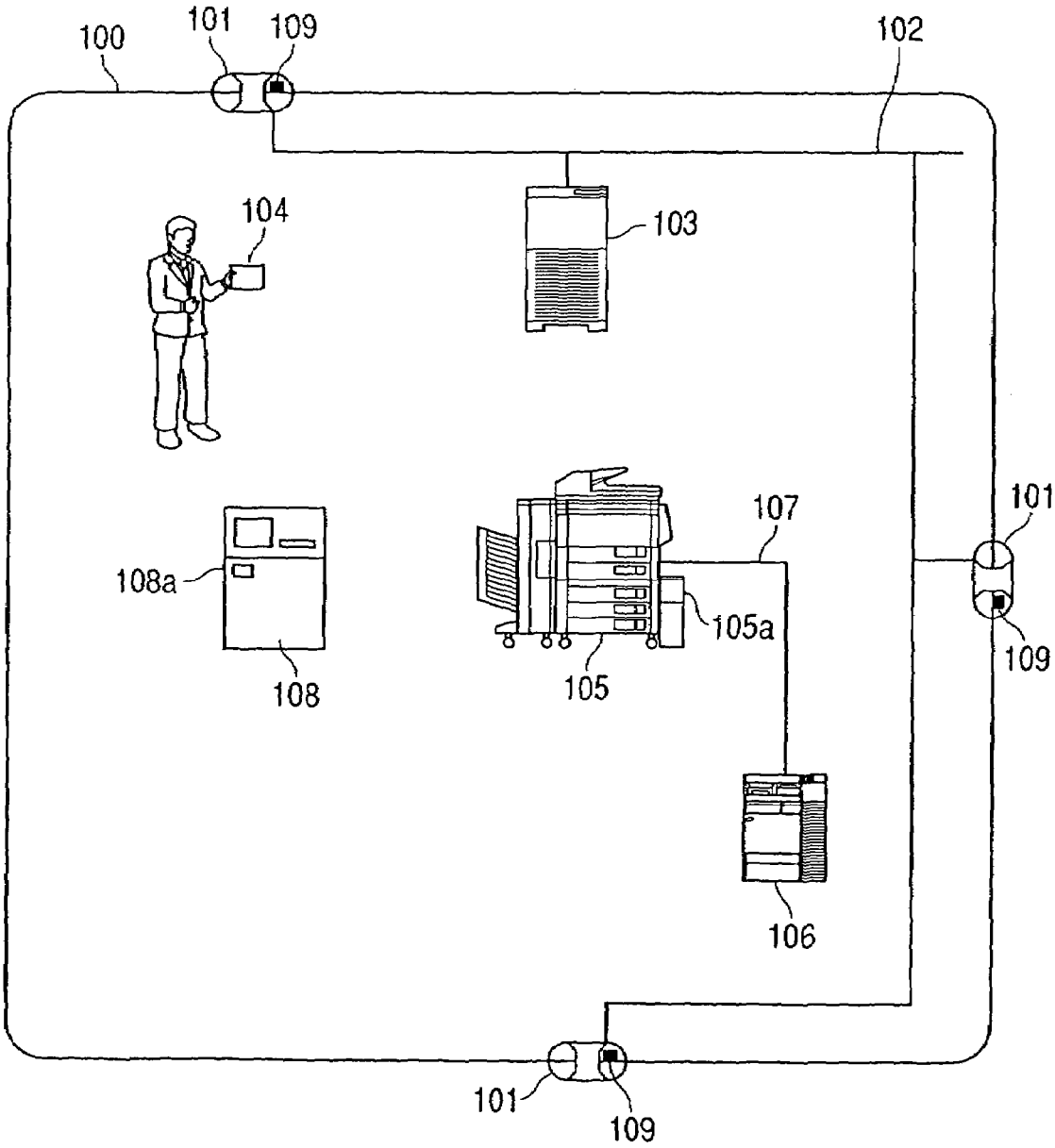
FIG. 1 is a diagram showing the schematic configuration of a security system according to the embodiment of the present invention.

The present invention will now be described in detail with reference to the accompanying drawings showing the preferred embodiment thereof. In the drawings, the elements and the parts which are identical throughout the views are designated by identical reference numerals, and duplicate description thereof is omitted.

Hereinafter, the embodiment of the present invention will be explained in detail with reference to the accompanying drawings.

Initially, FIG. 1 is a diagram showing the schematic configuration of a security system according to the embodiment of the present invention. In the security system according to the embodiment, a security area (also called a secret area) 100 which is the room comparted from the surroundings with plural physical gates such as gates, doors and the like, a physical wall (not shown), and the like is assumed. Further, a security server 103, an MFP (or a multifunctional machine) 105, a document server 106, and a payment apparatus 108 are disposed in the security area 100, and a gate control unit 101 is disposed in each of the physical gates such as the gates, the doors and the like to control open and close operations of the gate. Incidentally, it is inhibited to enter into and exit from the security area 100 in the state that the gate is being closed, and it is permitted to enter into and exit from the security area 100 in the state that the gate is being opened.

Moreover, a reader/writer 109 is disposed in each of the plural gates so as to access a nonvolatile memory 201 (FIG. 2) provided in an RFID tag (i.e., a non-contact IC memory) 104. The reader/writers 190 of the respective gates are mutually connected through a first network 102, and the gate control unit 101 and the security server 103 are also connected to the first network 102.

Figures 7, 8:
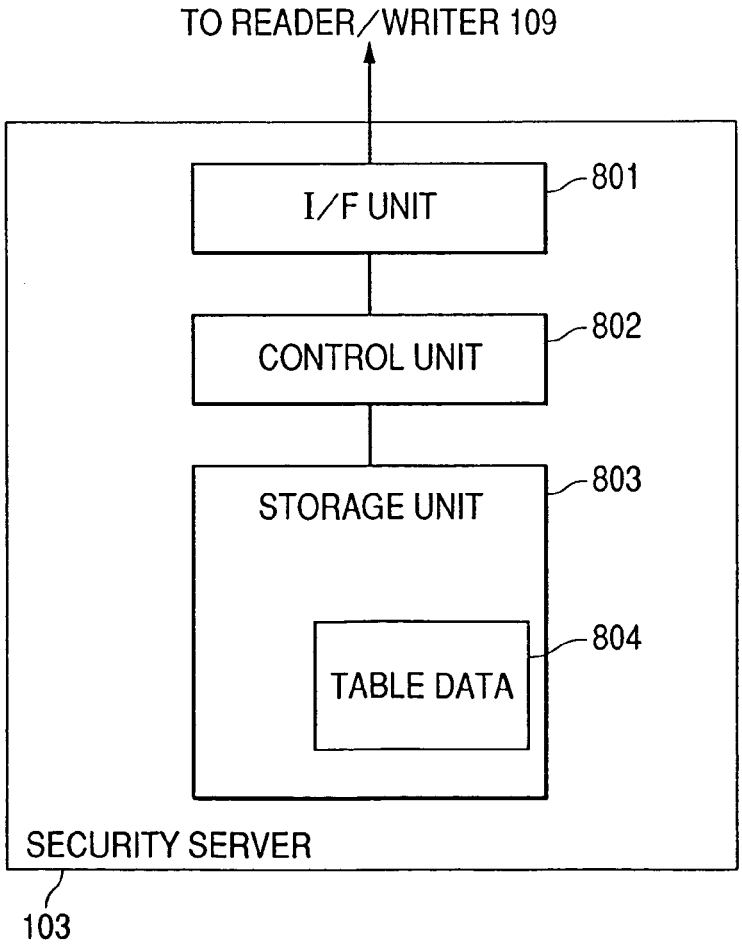
FIG. 7 is a diagram showing an example of entry/exit information read from the nonvolatile memory.
FIG. 8 is a block diagram showing the schematic structure of the security server.

As shown in FIG. 8, the security server 103 includes an I/F (interface) unit 801 for outputting and inputting information (data) to and from the reader/writer 109, a control unit 802 for wholly controlling the security server 103, and a storage unit 804 such as a hard disk or the like for storing later-described table data 804 and the like.

In the above network configuration, a user ID 401 (FIG. 4) stored in the nonvolatile memory 201 of the RFID tag 104 is read by the reader/writer 109, and the read user ID 401 is transferred to the security server 103. Thus, entrance and exit of users are administrated by the security server 103, and the gates are opened and closed through the gate control unit 101, whereby the security area 100 is formed as a whole.

In the embodiment, it is controlled by the gate control unit 101 to open and close the physical gate according to the administration of user entry/exit by the security server 103. However, to open and close the physical gate need not necessarily be controlled by the gate control unit 101.

Moreover, as later explained in detail, when the RFID tag 104 in which secret data (including job information, a command, etc.) is stored is brought out from the security area 100, the secret data in the RFID tag 104 is read by the reader/writer 109 and saved to the security server 103, and the secret data remaining in the RFID tag 104 is deleted concurrently, thereby preventing the secret data from leaking out to a third person outside the security area 100.

In addition, when the RFID tag 104 is again entered into the security area 100, the secret data saved in the security server 103 is again written into the RFID tag 104 through the reader/writer 109, whereby the written secret data can be freely used in the security area 100.

In the security area 100, a reader/writer 105*a* is mounted on the MFP 105, and a reader/writer 108*a* is mounted on the payment apparatus 108, whereby, as described later, the MFP 105 and the payment apparatus 108 can freely access the memory in the RFID tag 104 respectively through the reader/writer 105*a* and the reader/writer 108*a*.

Incidentally, it is desirable to physically separate the first network 102 from an external network (e.g., the Internet and the like) so as to improve secrecy. However, even if the first network 102 is not physically separated from the external network, it is possible to separate the first network 102 from the external network in information by means of a gateway or the like.

The MFP 105 is connected to the document server 106 through a second network 107 which is composed of a LAN, an SAN (storage area network) or the like. Here, it should be noted that the second network 107 need not necessarily be physically connected to the first network 102.

In case of using the RFID tag 104 in regard to the MFP 105, the RFID tag 104 is held above the reader/writer 105*a* of the MFP 105, whereby facsimile transmission destination information, an electronic mail address, location information of document data stored in the document server 106, and the like which have been stored in the RFID tag 104 are downloaded to the MFP 105 in a non-contact manner, whereby it is possible to execute facsimile transmission, electronic mail transmission, document print output, and the like in response to the downloaded data. Moreover, in the state that the RFID tag 104 is brought close to the reader/writer 105*a* of the MFP 105, it is possible in a non-contact manner through the reader/writer 105*a* to transfer to the facsimile transmission destination information, the electronic mail address, the location information of the document data stored in the document server 106, and the like from an operation unit (not shown) of the MFP 105 to the RFID tag 104, and it is then possible to store the transferred data in the nonvolatile memory 201 of the RFID tag 104.

For example, the payment apparatus 108 is located in a refectory, a messroom or the like. Therefore, in case of using the RFID tag 104 in regard to the payment apparatus 108, it is possible in the payment apparatus 108 to perform a payment process on the basis of a user ID or the like stored in the RFID tag 104. In this case, for example, when necessary and sufficient payment has been completed in the manner same as that applied to an ordinary prepaid card, it is possible in the payment apparatus 108 to perform the payment based on outstanding balance information stored in the RFID tag 104. Alternatively, when expense information for each user is accumulated and stored in a payment server (not shown) connected to the payment apparatus 108 in the security area 100, it is possible in the payment apparatus 108 to perform the payment for each user at intervals of, e.g., one month. By the way, when the content of each meal is stored in the payment server or the RFID tag 104, it is possible for the user to later refer to the stored history of the meals.

Here, it should be noted that the above use of the RFID tag 104 in regard to the MFP 105 and the above use of the RFID tag 104 in regard to the payment apparatus 108 are absolutely examples. That is, in addition to the above examples, the RFID tag 104 can be variously used. Moreover, it should be noted that the RFID tag 104 can be used by various electronic information apparatuses other than the MFP 105 and the payment apparatus 108 in the security area 100.

[RFID Tag]

Figure 2:
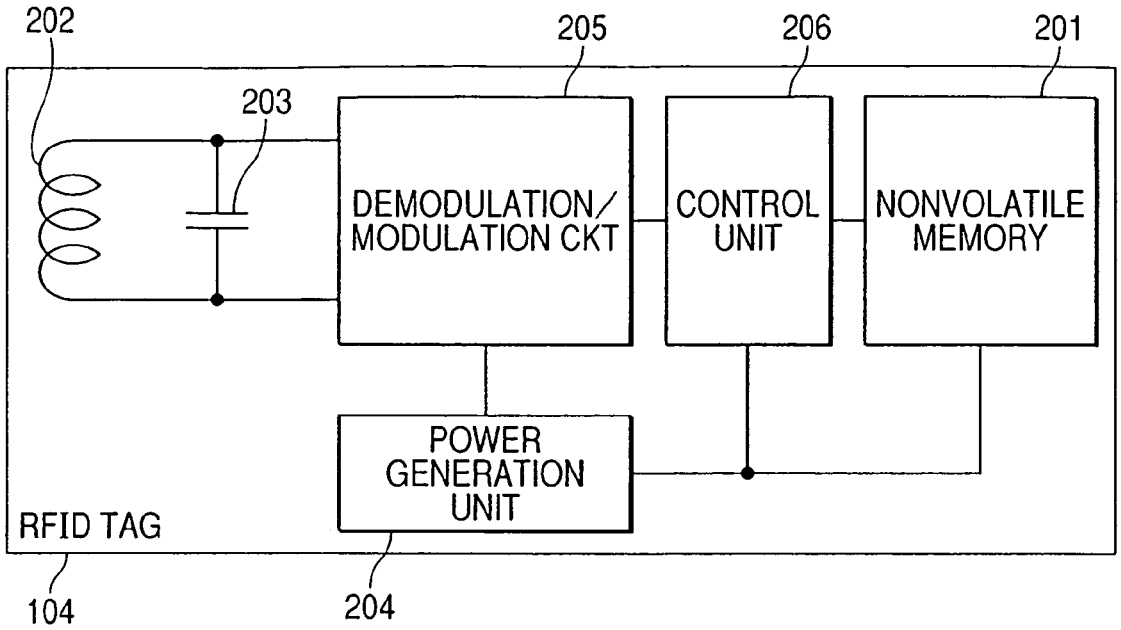
FIG. 2 is a block diagram showing the schematic structure of an RFID tag applicable to the security system according to the embodiment of the present invention.

FIG. 2 is a block diagram showing the schematic structure of the RFID tag 104. The RFID tag 104 which is also called a non-contact IC chip or a data carrier can communicate with the reader/writer by air (that is, in non-contact manner). In the embodiment, the RFID tag 104 is assumed as a card-type RFID tag which is the non-contact IC chip containing the following components.

That is, the nonvolatile memory 201, an antenna unit 202 for emitting and receiving radio waves, a resonant capacitor unit 203, a power generation unit 204 for rectifying and smoothing currents, a demodulation/modulation circuit 205 for demodulating and modulating the radio waves, and a control unit 206 are formed on the RFID tag (non-contact IC chip) 104. Incidentally, because the RFID tag 104 does not have any electrical power supply such as a battery or the like, necessary power is induced based on the radio waves supplied from the reader/writer.

More specifically, the combination of the antenna unit 202 and the resonant capacitor unit 203 constitutes a resonant circuit, and, as described later, the reader/writer always emits the radio wave (AC magnetic field) for generating electrical power. Therefore, when the RFID tag 104 is held above the reader/writer, an induction current is generated due to electromagnetic induction by the resonant circuit in the RFID tag 104. Then, the generated induction current is supplied to the power generation unit 204, whereby the power generation unit 204 rectifies and smoothes the supplied induction current and generates the electrical power of a predetermined voltage. Therefore, the generated electrical power is supplied to the nonvolatile memory 201, the control unit 206 and the demodulation/modulation circuit 205. Here, it should be noted that the control unit 206 wholly controls the RFID tag 104.

The reader/writer receives, in addition to the radio wave signal for generating the electrical power, radio wave signals concerning various data. The radio wave signals concerning various data are demodulated by the demodulation/modulation circuit 205, and the demodulated signals are written in the nonvolatile memory 201 under the control of the control unit 206. Moreover, the control unit 206 reads the data from the nonvolatile memory 201, the read data is modulated by the demodulation/modulation circuit 205, and the modulated data is transmitted as the radio wave signal through the antenna unit 202.

Figure 5:
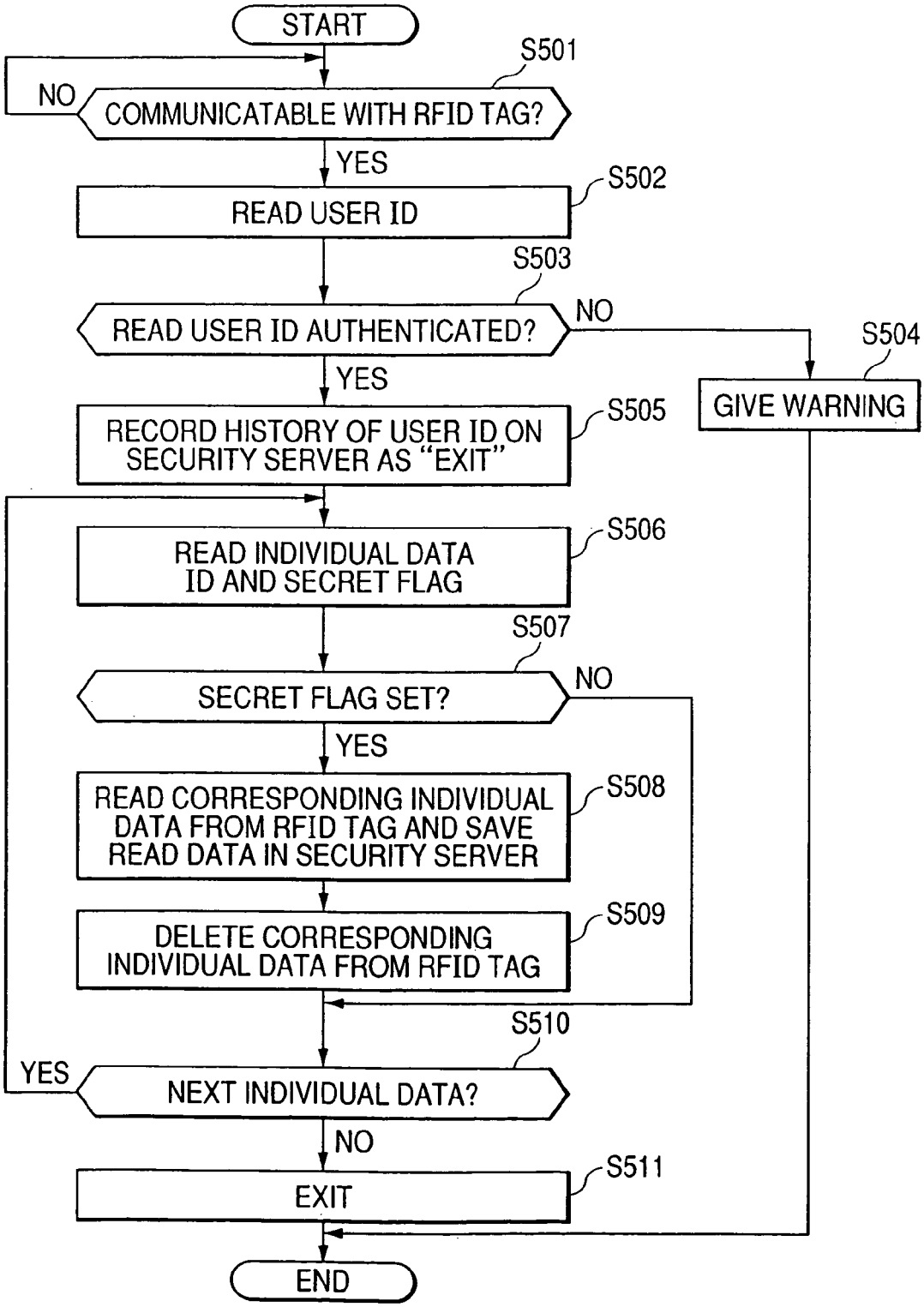
FIG. 5 is a flow chart showing the process of the security system in a case where the RFID tag is brought out from a security area.
Figure 6:
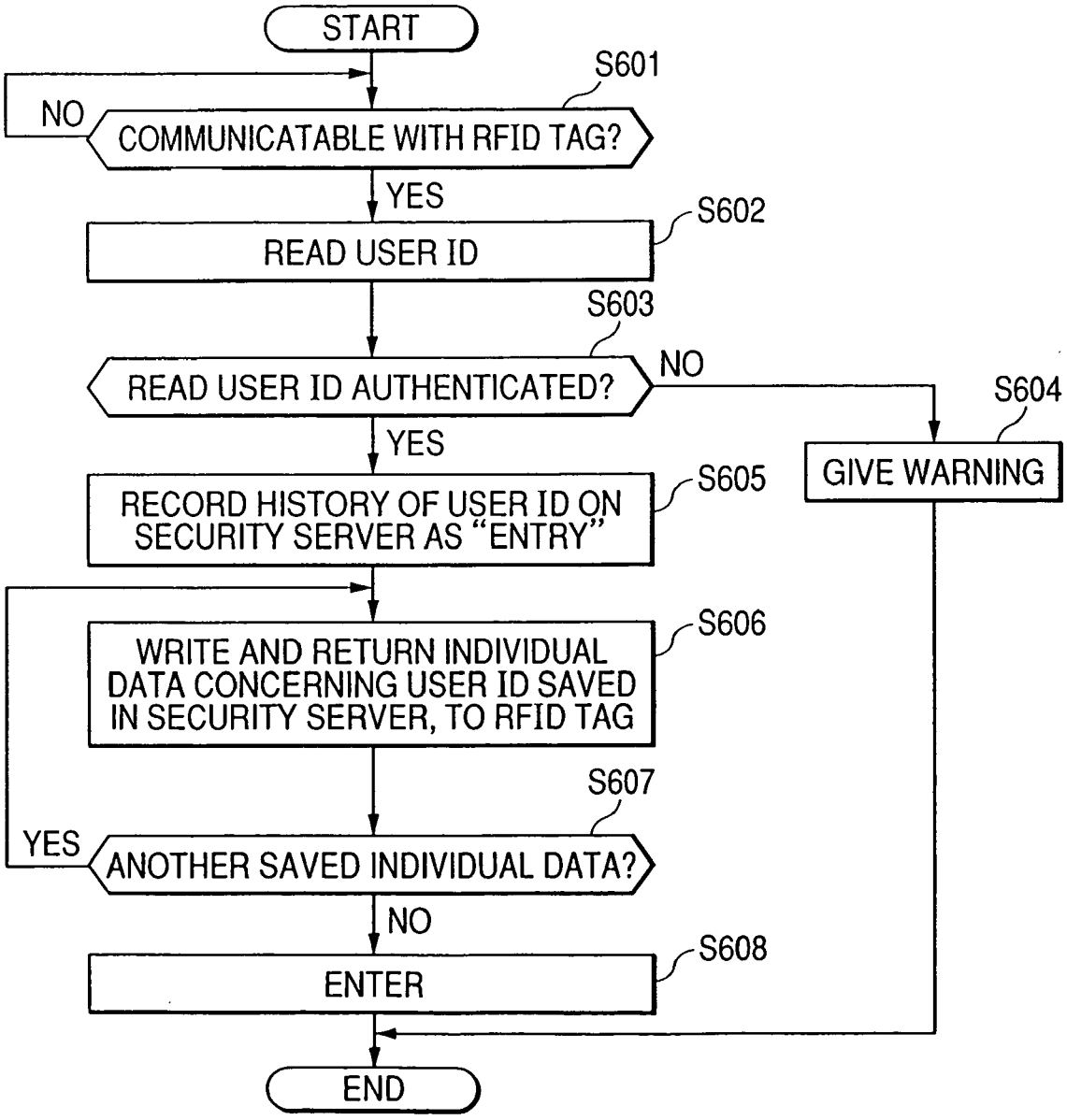
FIG. 6 is a flow chart showing the process of the security system in a case where the RFID tag is brought into the security area.

Incidentally, the control unit 206 includes a ROM (not shown) which stores application programs for performing the processes corresponding to steps S502 and S505 to S510 in a flow chart of FIG. 5 and steps S602 and S606 in a flow chart shown in FIG. 6. However, these application programs may be stored in the nonvolatile memory 201.

[Reader/Writer]

Figure 3:
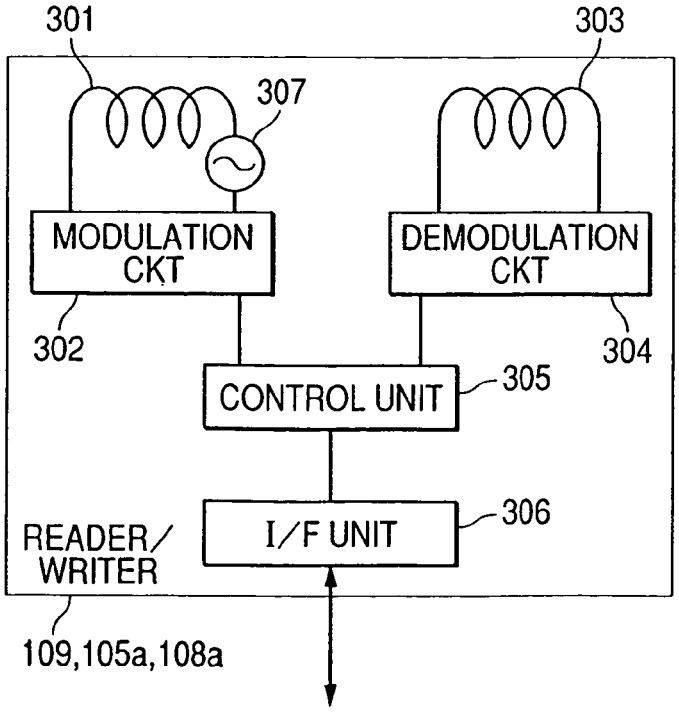
FIG. 3 is a block diagram showing the schematic structure of a reader/writer applicable to the security system according to the embodiment of the present invention.

FIG. 3 is a block diagram showing the schematic structure of each of the reader/writers 109, 105*a* and 108*a*. More specifically, each of the reader/writers 109, 105*a* and 108*a* includes a transmission antenna unit 301 for transmitting radio wave signals, a modulation circuit 302 for modulating the signal input from an I/F unit 306 into the data signal transmitted from the transmission antenna unit 301, a reception antenna unit 303 for receiving radio wave signals, a demodulation circuit 304 for demodulating the radio wave signal received by the reception antenna unit 303 into the signal to be output from the I/F unit 306, the I/F unit 306 for communicating with superior equipment (i.e., the security server 103 in the embodiment), and a control unit 305. Here, in such a configuration, the control unit 305 controls the transmission antenna unit 301, the modulation circuit 302, the reception antenna unit 303, the demodulation circuit 304 and the I/F unit 306. Incidentally, an AC power supply 307 for generating the power necessary to generate the radio wave signals is connected to the transmission antenna unit 301.

In response to an instruction issued from the security server 103, the control unit 305 causes the modulation circuit 302 to module the radio wave to be used for supplying the electrical power and the data to be transmitted, and the control unit 305 then causes the transmission antenna unit 301 to generate the radio wave. Moreover, the control unit 305 causes the demodulation circuit 304 to demodulate the radio wave signal received through the reception antenna unit 303, whereby the control unit 305 is then able to convert the demodulated signal to be treated as the data signal. In other words, the control unit 305 can write the information (data) into the nonvolatile memory 201 of the RFID tag 104 which is present within the transmission range of the transmission antenna unit 301, by causing the transmission antenna unit 301 to generate the radio wave signal. Moreover, the control unit 305 can read the information (data) from the nonvolatile memory 201 of the RFID tag 104 which is present within the reception range of the reception antenna unit 303, by causing the demodulation circuit 304 to demodulate the radio wave signal received through the reception antenna unit 303.

Incidentally, the control unit 305 includes a ROM (not shown) which stores application programs for performing the processes corresponding to the steps S502 and S505 to S510 in the flow chart of FIG. 5 and the steps S602 and S606 in the flow chart shown in FIG. 6.

[Storage Data of RFID Tag]

Figure 4:
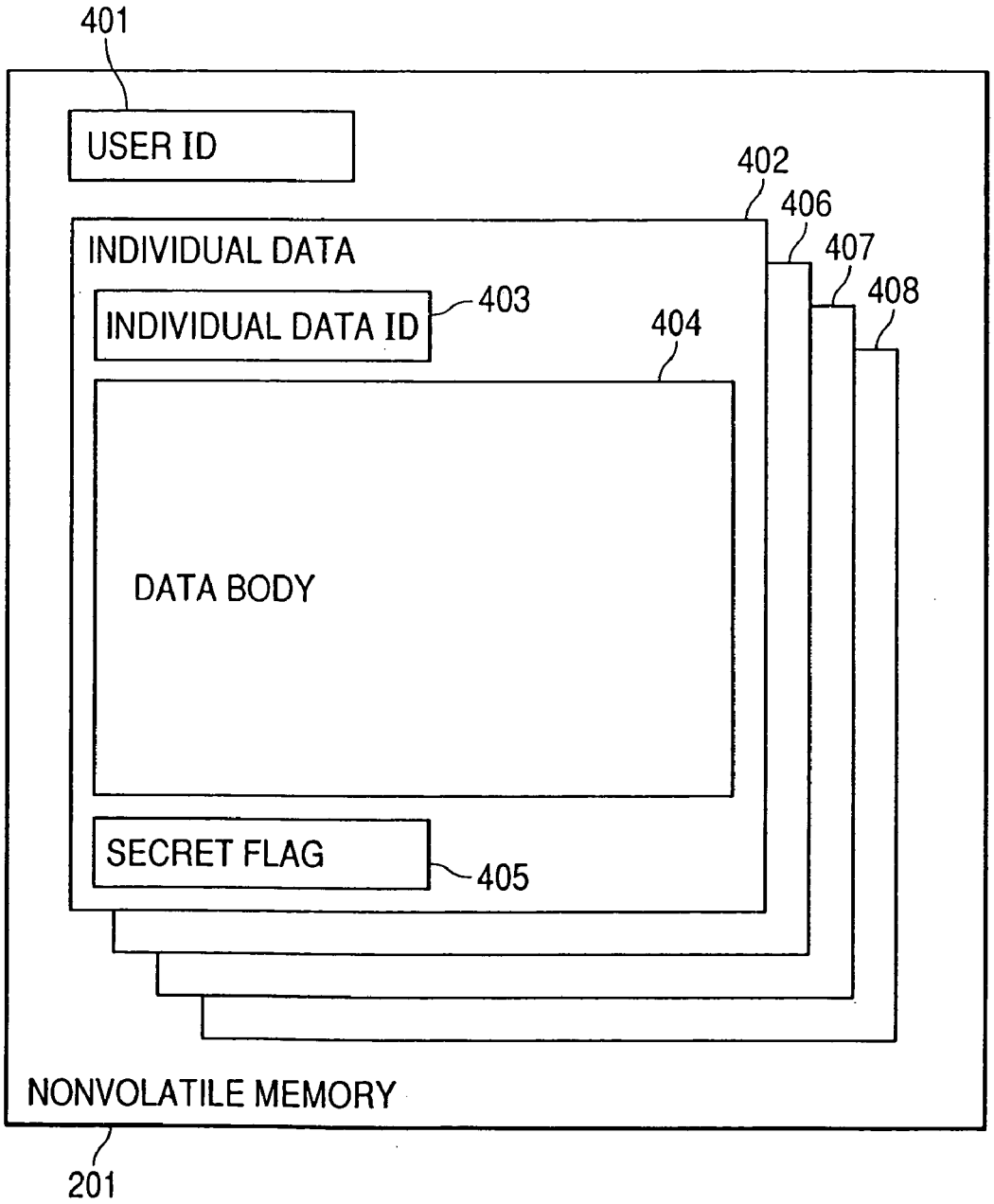
FIG. 4 is a conceptual diagram showing the data structure in the nonvolatile memory provided in the RFID tag.

FIG. 4 is a conceptual diagram showing the data structure in the nonvolatile memory 201 provided in the RFID tag 104.

The nonvolatile memory 201 provided in the RFID tag 104 stores the user ID 401 of the owner (i.e., the user) of the relevant RFID tag 104 and individual data 402 of this owner. As the user ID 401, inherent values (e.g., numerical values, symbols, etc.) are allocated to each of the RFID tags 104, whereby the user of the relevant RFID tag 104 can be authenticated based on the relevant user ID 401. That is, the user ID 401 stored in the nonvolatile memory 201 of the RFID tag 104 has been registered beforehand in the security server 103 before the security system according to the embodiment is actually used. Therefore, for example, when the user who has the RFID tag 104 passes the gate, the user ID 401 of this user is read from the relevant RFID tag 104 by the reader/writer 109, the read user ID 401 is checked based on the user ID registered in the security server 103, and it is thus judged whether or not to permit this user to pass the gate (this judgment is called authentication). Then, the entry and the exit of this user are recorded in the security server 103.

Incidentally, the number of individual data capable of being stored in the nonvolatile memory 201 is not of course limited to one. That is, plural individual data 402, 406, 407 and 408 may be stored in the single RFID tag 104, and each of the individual data 402, 406, 407 and 408 includes an individual data ID 403, a data body 404 (i.e., the body or substance of the actual individual data), and a secret flag 405.

The individual data ID 403 is the identification for discriminating each individual data 402 (i.e., the data body 404), and inherent values (e.g., numerical values, symbols, etc.) are allocated to each individual data 402, whereby the user of the relevant RFID tag 104 can be authenticated on the basis of the relevant user ID 401. Therefore, by combining the individual data ID 403 and the user ID 401 with each other, it is possible to transmit/receive the various data included in the data body 404 to/from the MFP 105 and the payment apparatus 108.

The data body 404 is the data being the substance of the individual data 402 which is actually read and written to be used in various processes. As described above, the facsimile transmission destination information, the electronic mail address, the location information of the document data stored in the document server 106, and the like are read and written as the data concerning the MFP 105. Incidentally, it is possible to add or overwrite the information input from the operation unit of the MFP 105.

Moreover, previously input money data, the history information of meals, and the like are read and written as the data concerning the payment apparatus 108. Here, it should be noted that the money data is the information which can be rewritten or updated only by a payment server (not shown) connected to the payment apparatus 108, and the history information of meals is the information which can be rewritten or updated by the payment apparatus 108.

The secret flag 405 is the information which is set with respect to each of the individual data 402, 406, 407 and 408, and represents whether or not the relevant individual data includes secret information. In the embodiment, it is defined that the individual data includes the secret information when the secret flag 405 is ON (1), while the individual data does not include the secret information when the secret flag 405 is OFF (0). Here, it should be noted that the secret flag 405 can be rewritten or updated only by the reader/writer 109 connected to the security server 103.

Incidentally, in the specification and the claims according to the present invention, with respect to the individual data of which the secret flag is ON, even if the whole of the individual data is not a secret matter but only a part thereof is a secret matter, the whole of the individual data is called the secret data.

[Exit Process]

Subsequently, the process to be performed when the person (user) exits from the security area 100 to the outside will be explained with reference to the flow chart shown in FIG. 5. Here, it should be noted that the process shown in FIG. 5 is performed by an information processing apparatus which is constituted by at least the security server 103 and the reader/writer 109.

First, in a step S501, it is judged by the control unit 305 of the reader/writer 109 whether or not it is possible to communicate with the RFID tag 104. Because the electrical power for the RFID tag 104 is induced based on the radio wave generated and transmitted from the reader/writer 109, the reader/writer 109 can communicate with the RFID tag 104 if the RFID tag 104 is brought close to the range in which the reader/writer 109 can perform the communication. Incidentally, it is set that the gate is not opened if a later-described predetermined authentication process is not performed by bringing the RFID tag 104 close to the reader/writer 109. Therefore, when the user wishes to exit from the security area 100, it is necessary for the user to bring the RFID tag 104 close to the reader/writer 109.

Then, in the step S502, the control unit 305 of the reader/writer 109 cooperates with the control unit 206 of the RFID tag 104 to read the user ID 401 from the nonvolatile memory 201 of the RFID tag 104 and transmit the read user ID 401 to the security server 103.

In a step S503, it is judged by the security server 103 whether or not the user ID 401 received from the reader/writer 109 has been already registered in the security server 103 and the entry/exit situation of the user corresponding to the received user ID 401 is "entry". That is, by doing so, it is resultingly judged whether or not to authenticate "exit" of this user. More specifically, when the user ID input through the control unit 305 of the reader/writer 109 matches with the user ID included in the table data 804 stored in the security server 103 and the entry/exit situation associated with the input user ID is set to "entry", the control unit 802 of the security server 103 authenticates "exit" of this user and also transmits authentication information to the reader/writer 109 through the I/F unit 801. Then, the flow advances to the step S505 when the security server authenticates "exit" of the user, while the flow advances to a step S504 when the security server does not authenticate "exit" of the user.

Here, it is assumed that the user ID of the user concerning the RFID tag 104 has been previously stored in a part of the storage area of the nonvolatile memory 201 of the RFID tag 104, as the information for identifying the relevant RFID tag 104. Further, it is assumed that the table data 804 for administrating the user ID's has been stored in the security server 103 (for example, the contents shown in FIG. 7 have been stored), and the entry/exit situation of the user (that is, the RFID tag 104 specified by the user ID) and the later-described secret information have been stored as the table data 804 in association with the user ID for specifying the RFID tag 104. Furthermore, it is assumed that the table data including the secret information and the like has been stored in the storage unit 803 such as a hard disk or the like in the security server 103.

Then, when the received user ID 401 is not registered in the security server 103, or when the entry/exit situation of the user associated with the input user ID 401 is set to "exit" even if the received user ID 401 has been registered in the security server 103 (that is, this case indicates that the user falsely entered into the security area 100 in the past), the security server 103 does not authenticate "exit" of this user and performs a predetermined warning process in the step S504. For example, a warning message may be displayed on a display (not shown) disposed at the gate, a warning sound may be generated by a speaker (not shown) disposed at the gate, or the gate may be temporarily closed and locked by the gate control unit 101.

On one hand, in the step S505, when the input user ID 401 has been registered in the security server 103 and the entry/exit situation of the user associated with the input user ID is set to "entry", the security server 103 authenticates "exit" of this user, changes the entry/exit situation of the user associated with the input user ID 401 to "exit", and notifies the reader/writer 109 of the information indicating that "exit" of this user is authenticated. Incidentally, when the information indicating that "exit" of this user is authenticated is received from the security server 103, the control unit 305 of the reader/writer 109 controls the modulation circuit 302 to write the information indicating that the user exited in the nonvolatile memory 201 of the RFID tag 104. Here, it should be noted that the information indicating that the user exited is the information indicating that the RFID tag 104 is in "exit" state (that is, the state that the RFID tag 104 does not exist in the security area 100).

In the embodiment, the storage unit 803 of the security server 103 stores only the latest entry/exit situation in order to reduce the storage capacity of the storage unit 803 to be used for the table data 804. However, it is possible to set that the storage unit 803 stores the whole past entry/exit situation or the plural entry/exit situations (i.e., history).

In the step S506, when the information indicating that "exit" of the relevant user is authenticated is received from the security server 103, the control unit 305 of the reader/writer 109 cooperates with the control unit 206 of the RFID tag 104 to read the individual data ID 403 of the one individual data 402 and the secret flag 405 from the nonvolatile memory 201 of the RFID tag 104 and then transmit the read data to the security server 103.

Then, in the step S507, it is judged by the control unit 802 of the security server 103 whether or not the secret flag 405 corresponding to the individual data 402 is ON.

In the step S508, when judged that the secret flag 405 is ON, the control unit 802 of the security server 103 causes the control unit 305 of the reader/writer 109 and the control unit 206 of the RFID tag 104 to cooperate with each other to read the corresponding individual data 402 (i.e., the data body 404) from the nonvolatile memory 201 of the RFID tag 104 and then transmit the read individual data 402 to the security server 103. Here, the control unit 802 of the security server 103 which received the individual data 402 from the nonvolatile memory 201 of the RFID tag 104 stores (saves), in association with the user ID authenticated in the step S503, the received individual data 402 as the table data 804 in the storage unit 803.

In the step S509, the control unit 305 of the reader/writer 109 deletes, from the nonvolatile memory 201, the individual data 402 saved in the storage unit 803 of the security server 103, and the flow then advances to the step S510.

Meanwhile, when judged by the control unit 802 in the step S507 that the secret flag 405 is OFF, the control unit 802 of the security server 103 and the control unit 305 of the reader/writer 109 skip the saving process of the step S508 and the deletion process of the step S509, and the flow directly advances to the step S510.

In the step S510, the control unit 305 of the reader/writer 109 cooperates with the control unit 206 of the RFID tag 104 to refer to the nonvolatile memory 201 of the RFID tag 104 to judge whether or not the next individual data of which the secret flag is not checked exists. As the result of this, when the next individual data of which the secret flag is not checked exists, the flow returns to the step S506. Thus, the control unit 305 of the reader/writer 109 performs the same process to the next individual data.

Meanwhile, the process of checking the secret flag for all the individual data 402 and 406 to 408 ends (that is, NO in the step S510), the flow advances to a step S511. In the step S511, for example, the control unit 305 of the reader/writer 109 performs an entry process of causing the gate control unit 101 to open the gate, and the process ends.

As explained above, when the entry/exit information read from the RFID tag 104 by the demodulation circuit 304 indicates "entry" and the secret flag 405 of the individual data 402 stored in the RFID tag 104 is ON, the control unit 305 of the reader/writer 109 saves or deletes the individual data 402 so that the individual data 402 stored in the RFID tag 104 cannot be read. Moreover, the control unit 305 of the reader/writer 109 controls the modulation circuit 302 so as to write the information indicating "exit" into the RFID tag 104.

The control unit 802 of the security server 103 judges in the step S507 whether or not the secret flag has been set with respect to each of the plural individual data 402, 406, 407 and 408 stored in the nonvolatile memory 201 of the RFID tag 104. Thus, it is possible to surely delete the data to be concealed from among the plural individual data, and it is also possible to leave the data which should not be concealed being stored in the nonvolatile memory 201.

[Entry Process]

Subsequently, the process to be performed when the person (user) who has the RFID tag 104 enters from the outside into the security area 100 will be explained with reference to the flow chart shown in FIG. 6. Here, it should be noted that the process shown in FIG. 6 is performed by the information processing apparatus which is constituted by at least the security server 103 and the reader/writer 109.

First, in a step S601, it is judged by the control unit 305 of the reader/writer 109 whether or not it is possible to communicate with the RFID tag 104. Because the electrical power for the RFID tag 104 is induced based on the radio wave generated and transmitted from the reader/writer 109, the reader/writer 109 can communicate with the RFID tag 104 if the RFID tag 104 is brought close to the range in which the reader/writer 109 can perform the communication. Incidentally, it is set that the gate is not opened if the later-described predetermined authentication process is not performed by bringing the RFID tag 104 close to the reader/writer 109. Therefore, when the user wishes to enter into the security area 100, it is necessary for the user to bring the RFID tag 104 close to the reader/writer 109.

Then, in the step S602, the control unit 305 of the reader/writer 109 cooperates with the control unit 206 of the RFID tag 104 to read the user ID 401 from the nonvolatile memory 201 of the RFID tag 104 and transmit the read user ID 401 to the security server 103.

In a step S603, it is judged by the security server 103 whether or not the user ID 401 received from the reader/writer 109 has been already registered in the security server 103 and the entry/exit situation of the user corresponding to the received user ID 401 is "exit". That is, by doing so, it is resultingly judged whether or not to authenticate "entry" of this user. More specifically, when the user ID input through the control unit 305 of the reader/writer 109 matches with the user ID included in the table data 804 stored in the security server 103 and the entry/exit situation associated with the input user ID is set to "exit", the control unit 802 of the security server 103 authenticates "entry" of this user and also transmits authentication information to the reader/writer 109 through the I/F unit 801. Then, the flow advances to a step S605 when the security server 103 authenticates "entry" of the user, while the flow advances to a step S604 when the security server 103 does not authenticate "entry" of the user.

Then, when the received user ID 401 is not registered in the security server 103, or when the entry/exit situation of the user associated with the input user ID 401 is set to "entry" even if the received user ID 401 has been registered in the security server 103 (that is, this case indicates that the user falsely exited from the security area 100 in the past), the security server 103 does not authenticate "entry" of this user and performs a predetermined warning process in the step S604. For example, a warning message may be displayed on the display disposed at the gate, a warning sound may be generated by the speaker disposed at the gate, or the gate may be temporarily closed and locked by the gate control unit 101.

On one hand, in the step S605, when the received input user ID 401 has been registered in the security server 103 and the entry/exit situation of the user associated with the input user ID is set to "exit", the security server 103 authenticates "entry" of this user, changes the entry/exit situation of the user associated with the input user ID 401 to "entry", and notifies the reader/writer 109 of the information indicating that "entry" of this user is authenticated. Incidentally, when the information indicating that "entry" of this user is authenticated is received from the security server 103, the control unit 305 of the reader/writer 109 controls the modulation circuit 302 to write the information indicating that the user entered in the nonvolatile memory 201 of the RFID tag 104. Here, it should be noted that the information indicating that the user entered is the information indicating that the RFID tag 104 is in "entry" state (that is, the state that the RFID tag 104 exists in the security area 100).

In the step S606, when the information indicating that the entry of the user corresponding to the user ID 401 has been authenticated is received from the security server 103, the control unit 305 of the reader/writer 109 inquires of the security server 103 as to the saved individual data 402 corresponding to the user ID 401 and then causes the security server 103 to transmit the individual data 402 to the reader/writer 109. Then, the control unit 305 of the reader/writer 109 cooperates with the control unit 206 of the RFID tag 104 to write and return the user ID 401 to the nonvolatile memory 201 of the RFID tag 104. For example, as shown in FIG. 7, when the user ID 401 is "13114039" on the table data 804 and the entry/exit information read from nonvolatile memory 201 in the step S603 indicates "exit", the control unit 802 of the security server 103 transmits information "aaa.txt" to the reader/writer 109 so that the information "aaa.txt" saved in the storage unit 803 as the secret data when the user exits is written and returned to the nonvolatile memory 201 of the RFID tag 104. When the information "aaa.txt" is received from the security server 103, the control unit 306 of the reader/writer 109 controls the modulation circuit 302 to write the information "aaa.txt" into the nonvolatile memory 104 of the RFID tag 104.

In a step S607, the control unit 305 of the reader/writer 109 inquires of the security server 103 as to whether or not the other saved individual data (i.e., the individual data 406, 407 and 408 shown in FIG. 4) corresponding to the user ID 401 exist. When the other saved individual data (i.e., the individual data 406, 407 and 408 shown in FIG. 4) exist, the flow returns to the step S606 to write and return the relevant other individual data to the nonvolatile memory 201 of the RFID tag 104.

Incidentally, in order to effectively use the storage area of the storage unit 803 in the security server 103, the control unit 802 of the security server 103 deletes, from the storage unit 803, the individual data written and returned to the nonvolatile memory 201. Moreover, as described above, the control unit 802 of the security server 103 transmits the saved individual data 402 to the reader/writer 109 in response to the inquiry or the like from the control unit 305 of the reader/writer 109. However, the control unit 802 of the security server 103 may actively search the saved individual data 402 on the basis of the user ID 401 received from the reader/writer 109 in the step S602, and transmit the searched individual data to the reader/writer 109.

Meanwhile, when the other saved individual data does not exist, for example, the control unit 305 of the reader/writer 109 performs an entry process of causing the gate control unit 101 to open the gate (step S608), and the process ends.

As just described, according to the embodiment, when the RFID tag 104 is brought out from the security area 100, the secret data on the RFID tag 104 is read therefrom and saved in the security server 103, and the saved security data remaining on the RFID tag 104 is deleted. Meanwhile, when the RFID tag 104 is brought into the security area 100, the saved secret data is written and returned to the RFID tag 104. Therefore, it is possible to prevent that the secret data leaks outside the security area 100 and is evilly used by a vicious third person. Moreover, because the saving, the deleting and the writing-returning of the secret data are automatically performed when the RFID tag 104 is held above the reader/writer 109, the load for the user does not increase.

Moreover, because a battery need not be provided in the RFID tag 104, the RFID tag 104 can be made compact in size, and also the security system can be structured at low cost. Furthermore, because the secret data is not restored if there is no user authentication, even if a user evilly enters into the security area 100 without any user authentication, he cannot use the secret data, whereby a security function further improves.

Modification of Embodiment

Even if the saving, the deleting and the writing-returning of the secret data stored in the RFID tag 104 are not performed in the manner as described above, leakage of the secret data can be prevented in the following manner.

That is, a readable flag associated with the individual data 402 is first stored in the nonvolatile memory 201 of the RFID tag 104. Then, the readable flag associated with the secret data is set to an unreadable state when the RFID tag 104 is brought out from the security area 100, and the readable flag associated with the secret data is set to a readable state when the RFID tag 104 is brought into the security area 100. Thus, it is possible to prevent a leakage of the secret data outside the security area 100, and it is possible to freely use the secret data within the security area 100.

In this case, only when the user of the RFID tag 104 has been authenticated by the security server 103, it is necessary to be able to change the flag value of the readable flag by, e.g., the reader/writer 109. Moreover, in the RFID tag 104, it is necessary to provide a control mechanism in the control unit 206 or a memory controller (not shown) to preclude from reading the individual data (secret data) of which the readable flag is set to the unreadable state, so that the secret data cannot be read by a commercially available reader/writer or the like for the RFID tag.

In the above embodiment, because it is necessary to perform the saving, the deleting or the writing-returning of the secret data, it is thought that a time necessary for the entry/exit administration is prolonged. On the other hand, in the modification of the embodiment, because the secret data is not directly processed, it is possible to shorten the time necessary for the entry/exit administration. However, because the secret data is brought out from the security area 100 as a matter of form, some uneasiness remains in the point of security in the modification. For these reasons, whether to select the embodiment or the modification only has to be decided based on whether to attach importance to the security or the time necessary for the entry/exit administration.

Incidentally, if an accessible flag instead of the above readable flag is defined as the component of the individual data 402, it is possible to prevent the secret data from being damaged by, e.g., overwriting of another data.

Moreover, even when the RFID tag is not used for the entry/exit administration, the present invention is applicable also to a case where the RFID tag is used only to record the data used by various devices. In this case, as the means for detecting that the RFID tag is brought out from and brought into the secret area, it is unnecessary to use a specific reader/writer for the RFID tag. For example, in a case where the RFID tag is used as a medium for paying necessary play fees in a game hall such as a pachinko hall, a computer game amusement center or the like, a magnetic field (i.e., the secret area) is formed by a predetermined device in the game hall, and a device for detecting the magnetic field is mounted on the RFID tag. Thus, it is possible by such a detection device to detect that the RFID tag is brought out from and brought into the secret area.

Incidentally, in the case where the RFID tag is used as the medium for paying necessary play fees in the game hall, the secret data leakage prevention process according to the above embodiment or the above modification is used to prevent that the prepaid information stored in the RFID tag is used in another business people's game hall.

Further, it is possible to provide a battery in the RFID tag. In this case, it is possible to cause the control unit of the RFID tag not to cooperate with the control unit of the reader/writer but to independently perform the secret data leakage prevention process according to the above embodiment or the above modification.

Furthermore, as the secret data leakage prevention process, it is possible to adopt a process of encrypting the secret data in the RFID tag when the RFID tag in question is brought out from the secret area, and decrypting the encrypted secret data in the RFID tag when the RFID tag in question is brought into the secret area (here, also performing user authentication if necessary).

Moreover, in the communication method adopted for the RFID tag, the radio waves, the electromagnetic waves and the like need not necessarily be used. That is, for example, a communication method using a light such as an infrared light and the like may be adopted. Besides, the shape of the RFID tag is not limited to a card type, that is, a label-type RFID tag, a coin-type RFID tag, a box-type RFID tag, a stick-type RFID tag and the like may be used.

Moreover, it is needless to say that the object of the present invention is achieved in a case where the program codes of software for achieving the functions of the above embodiment and modification are wirelessly downloaded in non-contact manner to the RFID tag and the reader/writer and the downloaded program codes are thus executed by the control units of the RFID tag and the reader/writer.

In this case, the program codes themselves achieve the functions of the above embodiment and modification, whereby the storage medium which stores these program codes constitutes the present invention. Moreover, it is needless to say that the present invention includes not only the case where the functions of the above embodiment and modification are achieved when the above program codes are executed, but also a case where the functions of the above embodiment and modification are achieved when operating systems (OS) or the like operating on the RFID tag and the reader/writer perform a part or all of the actual processes in response to instructions of the program codes.

As many apparently widely different embodiments of the present invention can be made without departing from the spirit and scope thereof, it is to be understood that the invention is not limited to the specific embodiments thereof except as defined in the appended claims.

This application claims priority from Japanese Patent Application No. 2003-392377 filed Nov. 21, 2003, which is hereby incorporated by reference herein.

The invention claimed is:

1. An information processing apparatus comprising:

an information reading unit adapted to read information from a portable storage medium;

an information writing unit adapted to write information into the portable storage medium;

a storage unit adapted to store the information read from the portable storage medium by said information reading unit; and a control unit adapted to control said information reading unit and said information writing unit, wherein, said control unit is adapted to control said information reading unit to read predetermined information from the portable storage medium, to store the read predetermined information in said storage unit, and to preclude from reading the predetermined information stored in the portable storage medium in a case where the portable storage medium is moved out of a predetermined area, and wherein said control unit is adapted to control said information writing unit to write the predetermined information stored in said storage unit into the portable storage medium in a case where the portable storage medium is moved into the predetermined area.

2. An information processing apparatus according to claim 1, wherein said control unit is adapted to control said information writing unit to delete the predetermined information stored in the portable storage medium in a case where the portable storage medium is moved out of the predetermined area.

3. An information processing apparatus according to claim 1, wherein said control unit is adapted to control said information writing unit to write reading-preclusive information into the portable storage medium in a case where the portable storage medium is moved out of the predetermined area, the reading-preclusive information for precluding from reading the predetermined information from the portable storage medium.

4. An information processing apparatus according to claim 3, wherein said control unit is adapted to control said information writing unit to delete the reading-preclusive information from the portable storage medium in a case where the portable storage medium is moved into the predetermined area.

5. An information processing apparatus according to claim 1, wherein said control unit is adapted to control said information reading unit to preclude from reading the predetermined information stored in the portable storage medium and designated to be secret, in a case where the portable storage medium is moved out of the predetermined area.

6. An information processing apparatus according to claim 1, wherein the portable storage medium is a storage medium to which communication is possible in non-contact manner, said information reading unit is adapted to write the information into the portable storage medium in non-contact manner, and said information writing unit is adapted to read the information from the portable storage medium in non-contact manner.

7. An information processing apparatus according to claim 1, wherein said information reading unit is adapted to read specific information, stored in the portable storage medium, for specifying the portable storage medium, said storage unit is adapted to store the predetermined information with first specific information read by said information reading unit, and said information writing unit is adapted to write the predetermined information corresponding to the first specific information into the portable storage medium in a case where second specific information read from the portable storage medium matches with the first specific information stored in said storage unit.

8. An information processing apparatus according to claim 1, wherein said information writing unit is adapted to write area information indicating whether or not the portable storage medium exists in the predetermined area, said controlling unit is adapted to control said information writing unit to write the area information indicating that the portable storage medium does not exist in the predetermined area in a case where area information read from the portable storage medium by said information reading unit indicates that the portable storage medium exists in the predetermined area, and said controlling unit is adapted to control said information writing unit to write the predetermined information stored in the storage unit into the portable storage medium in a case where the area information read from the portable storage medium by said information reading unit indicates that the portable storage medium does not exist in the predetermined area.

9. An information processing apparatus comprising:

an information reading unit adapted to read information from a portable storage medium;

an information writing unit adapted to write information into the portable storage medium;

a storage unit adapted to store the information read from the portable storage medium by said information reading unit; and a control unit adapted to control said information reading unit and said information writing unit, an administration unit adapted to administrate specific information, stored in the portable storage medium, for specifying the portable storage medium;

a judgment unit adapted to judge whether or not the specific information read from the portable storage medium by said information reading unit matches with the specific information administrated by said administration unit, wherein said control unit is adapted to control said information reading unit to preclude from reading predetermined information stored in the portable storage medium in a case where the portable storage medium is moved out of a predetermined area and it is judged by said judgment unit that the specific information read from the portable storage medium matches with the specific information administered by said administration unit.

10. An information processing apparatus according to claim 9, further comprising a warning unit adapted to give warning when it is judged by said judgment unit that the specific information read from the portable storage medium does not match with the specific information administrated by said administration unit.

11. An information processing apparatus according to claim 9, wherein said control unit is adapted to control said information reading unit to be able to read the predetermined information from the portable storage medium in a case where the portable storage medium is moved out of the predetermined area and it is further judged by said judgement unit that the specific information read from the portable storage medium matches with the specific information administered by said administration unit.

12. An information processing method, comprising:

an information reading step of reading information from a portable storage medium;

and information writing step of writing information into the portable storage medium; and a storage step of, reading the predetermined information from the portable storage medium and storing the read predetermined information in another storage medium different from the portable storage medium in a case where the portable storage medium is moved out of a predetermined area, wherein said information reading step precludes from reading the predetermined information stored in the portable storage medium in a case where the portable storage medium is moved out of the predetermined area, and said information writing step writes the predetermined information stored in the storage medium into the portable storage medium in a case where the portable storage medium is moved into the predetermined area.

13. An information processing method according to claim 12, wherein said information writing step deletes the predetermined information stored in the portable storage medium in a case where the portable storage medium is moved out of the predetermined area.

14. An information processing method according to claim 12, wherein said information writing step writes reading-preclusive information into the portable storage medium in a case where the portable storage medium is moved out of the predetermined area, the reading-preclusive information for precluding from reading the predetermined information from the portable storage medium.

15. An information processing method according to claim 14, wherein said information writing step reads the predetermined information from the portable storage medium in a case where the portable storage medium is moved into the predetermined area.

16. An information processing method according to claim 12, wherein said information reading step precludes from reading the predetermined information stored in the portable storage medium and designated to be secret, in a case where the portable storage medium is moved out of the predetermined area.

17. An information processing method according to claim 12, wherein the portable storage medium is a storage medium to which communication is possible in non-contact manner, said information reading step is adapted to write the information into the portable storage medium in non-contact manner, and said information writing step is adapted to read the information from the portable storage medium in non-contact manner.

18. An information processing method according to claim 12, wherein said information reading step reads specific information, stored in the portable storage medium, for specifying the portable storage medium, said storage step stores the predetermined information with first specific information read in said information reading step, and said information writing step writes the predetermined information corresponding to the first specific information in a case where second specific information read from the portable storage medium matches with the first specific information stored in said another storage medium.

19. An information processing method according to claim 12, wherein said information writing step writes area information indicating whether or not the portable storage medium exists in the predetermined area, said information writing step writes the area information indicating that the portable storage medium does not exist in the predetermined area in a case where area information read from the portable storage medium in said information reading step indicates that the portable storage medium exists in the predetermined area, and said information writing step writes the predetermined information stored in the storage unit into the portable storage medium in a case where the area information read from the portable storage medium in said information reading step indicates that the portable storage medium does not exist in the predetermined area.

20. An information processing method comprising:

an information reading step of reading information from a portable storage medium;

an information writing step of writing information into the portable storage medium; and a judgment step of judging whether or not specific information read from the portable storage medium in said information reading step matches with specific information administrated in another storage medium, wherein said information reading step precludes from reading predetermined information stored in the portable storage medium in a case where the portable storage medium is moved out of the predetermined area and it is judged in said judgement step that the specific information read from the portable storage medium matches with the specific information administrated in the another storage medium.

21. An information processing method according to claim 20, further comprising a warning step of giving warning when it is judged in said judgment step that the specific information read from the portable storage medium does not match with the specific information administrated in the another storage medium.

22. An information processing method according to claim 20, wherein said information reading step reads the predetermined information from the portable storage medium in a case where the portable storage medium is moved out of the predetermined area and it is further judged in said judgement step that the specific information read from the portable storage medium matches with the specific information administrated in the another storage medium.

* * * * *

UNITED STATES PATENT AND TRADEMARK OFFICE

CERTIFICATE OF CORRECTION

PATENT NO. : 7,278,022 B2
APPLICATION NO. : 10/533100
DATED : October 2, 2007
INVENTOR(S) : Suzuki It is certified that error appears in the above-identified patent and that said Letters Patent is hereby corrected as shown below:

COLUMN 1:
Line 19, “an.” should read -- an --.

COLUMN 6:
Line 9, “of,” should read -- of --; and
Line 44, “secret,” should read -- secret --.

Signed and Sealed this

Tenth Day of June, 2008

JON W. DUDAS
*Director of the United States Patent and Trademark Office*